US007137455B2

(12) United States Patent
Green

(10) Patent No.: US 7,137,455 B2
(45) Date of Patent: Nov. 21, 2006

(54) SPRINKLER HEAD WITH IMPROVED FLOW

(75) Inventor: Brian S Green, Nashville, MI (US)

(73) Assignee: The Viking Corporation, Hastings, MI (US)

( * ) Notice: Subject to any disclaimer, the term of this patent is extended or adjusted under 35 U.S.C. 154(b) by 31 days.

(21) Appl. No.: 10/951,080

(22) Filed: Sep. 27, 2004

(65) Prior Publication Data

US 2005/0067171 A1 Mar. 31, 2005

Related U.S. Application Data

(60) Provisional application No. 60/505,814, filed on Sep. 25, 2003.

(51) Int. Cl.
*A62C 37/08* (2006.01)

(52) U.S. Cl. ..... 169/37; 239/498; 239/504; 239/522; 239/523; 239/524

(58) Field of Classification Search ..... 169/37; 239/498, 504, 522, 523, 524
See application file for complete search history.

(56) References Cited

U.S. PATENT DOCUMENTS

| | | | | |
|---|---|---|---|---|
| 1,921,231 | A | 8/1933 | Jourdan | |
| 2,391,616 | A | 12/1945 | Causer | |
| 2,664,956 | A | 1/1954 | Bairz | |
| 3,161,236 | A | 12/1964 | MaCartney | |
| 3,314,482 | A | 4/1967 | Young | |
| 3,336,984 | A | 8/1967 | MaCartney | |
| 3,561,537 | A | 2/1971 | Dix et al. | |
| 3,880,239 | A * | 4/1975 | Vorkapich | 169/37 |
| 4,167,974 | A * | 9/1979 | Job | 169/38 |
| 4,273,195 | A | 6/1981 | Fischer et al. | |
| 4,279,309 | A | 7/1981 | Fischer et al. | |
| 4,296,815 | A * | 10/1981 | Mears | 169/37 |
| 4,296,816 | A | 10/1981 | Fischer | |
| 4,732,216 | A | 3/1988 | Polan | |
| 4,987,957 | A | 1/1991 | Galaszewski | |
| 5,103,864 | A * | 4/1992 | Austin | 137/561 A |
| 5,125,579 | A * | 6/1992 | Eggert | 239/439 |
| 5,722,599 | A | 3/1998 | Fries | 239/504 |
| 5,727,737 | A * | 3/1998 | Bosio et al. | 239/504 |
| 5,735,319 | A * | 4/1998 | McNamara et al. | 141/286 |
| 5,810,263 | A * | 9/1998 | Tramm | 239/518 |
| 5,862,994 | A * | 1/1999 | Pounder et al. | 239/498 |
| 6,098,718 | A * | 8/2000 | Sato | 169/37 |
| 6,374,919 | B1 * | 4/2002 | Neill | 169/37 |
| 6,374,920 | B1 * | 4/2002 | Phillips et al. | 169/37 |
| 6,920,937 | B1 * | 7/2005 | Neill et al. | 169/37 |

FOREIGN PATENT DOCUMENTS

EP 0339788 A2 11/1989

* cited by examiner

*Primary Examiner*—Justine R. Yu
*Assistant Examiner*—Trevor McGraw
(74) *Attorney, Agent, or Firm*—Harness, Dickey & Pierce, P.L.C.

(57) ABSTRACT

A sprinkler head assembly includes a sprinkler head body, a frame including a pair of arms extending from the body from opposed sides of the body, and a deflector mounted to the frame spaced from the outlet opening of the sprinkler head body for deflecting fire extinguishing liquid flowing from the outlet opening. The sprinkler head assembly is adapted to direct a greater proportion of the fire extinguishing liquid from one side of the sprinkler body than the other side of the sprinkler body.

58 Claims, 13 Drawing Sheets

SPRINKLER HEAD WITH IMPROVED FLOW

This application claims priority from U.S. provisional application Ser. No. 60/505,814, filed Sep. 25, 2003, entitled SPRINKLER HEAD WITH IMPROVED FLOW, by Applicant Brian S. Green, and is incorporated by reference herein in its entirety.

TECHNICAL FIELD AND BACKGROUND OF THE INVENTION

The present invention relates to a fire protection sprinkler head.

Conventional dependent sprinklers typically disperse the fire suppressant liquid in a substantially uniform radial canopy while balancing the desire to maximize the area of coverage and the need to maintain the density of fire suppressant liquid across the area to be covered above a threshold level, which is set by a uniform standard code.

In sidewall and pitched roof or wall applications, a radial canopy is not necessarily desirable and, in some cases, is undesirable. In sidewall applications, the goal is deliver fire suppressant to the wall or walls at the sprinkler location and to the walls across from the sprinkler and to deliver fire suppressant across the floor area between the walls, which typically cannot be achieved efficiently using a radial canopy. Heretofore, most sidewall sprinklers use the upper half of the suppressant that flows from the outlet of the sprinkler to wet the distant walls (walls across from the sprinkler and distant side walls) and the floor area near the distant walls. The lower half of the fire suppressant is then typically used to wet near walls, including the wall on which the sprinkler is mounted, and the floor area surrounding the near walls. It has been found, however, that the density of the fire suppressant at the near walls and near floor areas typically significantly exceeds the density of the fire suppressant at the distant walls and distant floor areas. Hence most conventional sidewall sprinklers are inefficient and tend waste significant amounts of fire suppressant.

Consequently, there is a need to a sidewall sprinkler that can disperse fire suppressant with a more uniform distribution to reduce the amount of fire suppressant that is needed for a given area of coverage.

SUMMARY OF THE INVENTION

Accordingly, the present invention provides a sprinkler head that is adapted to direct the flow of fire suppressant liquid the sprinkler head such that a greater amount of fire suppressant liquid flows through one side or half of the sprinkler head, which is especially useful in a sidewall.

In one form of the invention, a sprinkler head includes a sprinkler head body, a deflector, which is spaced from the outlet opening of the sprinkler head body, and a frame that supports the deflector in spaced registry with the outlet opening of the sprinkler head body. The sprinkler head body has a transverse passage, which extends through the body and provides the inlet opening and the outlet opening. The sprinkler head body has a central axis that extends though the transverse passage, with the central axis lying in a reference plane. The sprinkler head assembly is adapted to direct a greater proportion of the fire extinguishing liquid that flows through the sprinkler head body to one side of the plane than the other side of the plane wherein the greater proportion of fire extinguishing liquid can be dispersed from one side of the sprinkler head.

In one aspect, the sprinkler head body is adapted to direct a greater proportion in a range of 55% to 85%, more preferably, in a range of 60% to 80% and, most preferably, in a range of 65% to 75% of the fire extinguishing liquid to the one side of the plane.

In a further aspect, the sprinkler head body is adapted to direct a greater proportion of the fire extinguishing liquid above the plane. For example, the transverse passage may include a central axis, with the central axis of the transverse passage being offset relative to the central axis of the sprinkler head body wherein a greater proportion of the fire extinguishing liquid flowing from the outlet opening flows above the plane rather than below the plane. For example, the central axis of the transverse passage may be offset from the central axis of the sprinkler head body in a range of 1/64 of an inch to 3/16 of an inch and, more preferably, in a range of 1/32 of an inch to 1/8 of an inch.

According to another aspect, the frame of the sprinkler head assembly is adapted to direct a greater proportion of the fire extinguishing liquid above the plane. For example, the frame may include a boss, to which the deflector is mounted, with the boss being adapted to direct a greater proportion of the fire extinguishing liquid above the plane. The boss includes a diverging surface that disperses the fire extinguishing liquid from the outlet opening at the sprinkler head body and is adapted to direct a greater proportion of the fire extinguishing liquid above the plane. For example, the boss may be offset from the plane wherein the diverging surface directs a greater proportion of the fire extinguishing liquid above the plane.

According to yet another aspect, the deflector may be adapted to direct a greater proportion of the fire extinguishing liquid above the plane than below the plane. For example, the deflector may be offset from the central axis of the sprinkler head body. In a further aspect, the deflector includes a central body, a plurality of tines, which extend from the central body, and a generally horizontal portion, which is supported from the central portion above the central axis. The generally horizontal portion is spaced from the central portion to thereby define an opening through the deflector below the generally horizontal portion, which is at least substantially above the central axis. The central portion is mounted to the frame and is generally perpendicular to the central axis. At least one tine has a portion turned upwardly in a direction toward the central axis and toward the outlet opening. With this configuration and mounting arrangement, the deflector directs a greater proportion of the fire extinguishing liquid above the plane than below the plane.

In a further aspect, at least two of the tines have upwardly turned portions.

In other aspects, at least a pair of the tines is angled outwardly from the central body in a direction away from the outlet opening and generally along the central axis. Another pair of tines may extend from the central body in a direction away from the central axis toward the generally horizontal portion.

In other aspects, the generally horizontal portion comprises a plate member with opposed sides, which extend in a direction generally parallel to the central axis, and an outer edge, which is generally perpendicular to the central axis. In a further aspect, each of the opposed sides to the generally horizontal portion includes at least one slot that extends into the plate member. Preferably, each of the opposed sides of the generally horizontal portion includes a plurality of slots, which form tines. These tines may be angled in a direction downwardly from the generally horizontal portion towards the central axis. In addition, the outer edge of the plate member may form a curved outer edge and, preferably, may form a symmetrically curved outer edge relative to the central axis.

According to yet another form of the invention, a sprinkler head includes a sprinkler head body, a deflector, which is spaced from the outlet opening of the sprinkler head body, and a frame that supports the deflector in spaced registry with the outlet opening of the sprinkler head body. The sprinkler head body has a transverse passage, which extends through the body and provides the inlet opening and the outlet opening. The sprinkler head body has a central axis that extends though the transverse passage, with the central axis lying in a reference plane. The deflector includes a central body, a plurality of tines, which extend from the central body, and a generally horizontal portion, which is supported from the central portion above the central axis. The generally horizontal portion is spaced from the central portion to thereby define an opening through the deflector below the generally horizontal portion, which is at least substantially above the central axis. The central portion is mounted to the frame and is generally perpendicular to the central axis. At least one tine has a portion turned upwardly in a direction toward the central axis and toward the outlet opening.

In a further aspect, at least two of the tines are angled outwardly from the central body in a direction away from the outlet opening and generally along the central axis. Another pair of tines may extend from the central body in a direction away from the central axis toward the generally horizontal portion.

In other aspects, the generally horizontal portion comprises a plate member with opposed sides, which extend in a direction generally parallel to the central axis, and an outer edge, which is generally perpendicular to the central axis.

In a further aspect, each of the opposed sides to the generally horizontal portion includes at least one slot that extends into the plate member. Preferably, each of the opposed sides of the generally horizontal portion includes a plurality of slots, which form tines. These tines may be angled in a direction downwardly from the generally horizontal portion towards the central axis. In addition, the outer edge of the plate member may form a curved outer edge and, preferably, may form a symmetrically curved outer edge relative to the central axis.

Accordingly, the present invention provides a sprinkler head that exhibits an improved distribution of the fire suppressant liquid so that in a sidewall sprinkler application, greater wall wetting and a greater distribution of the fire suppressant liquid across the floor of the area to be protected can be achieved.

These and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
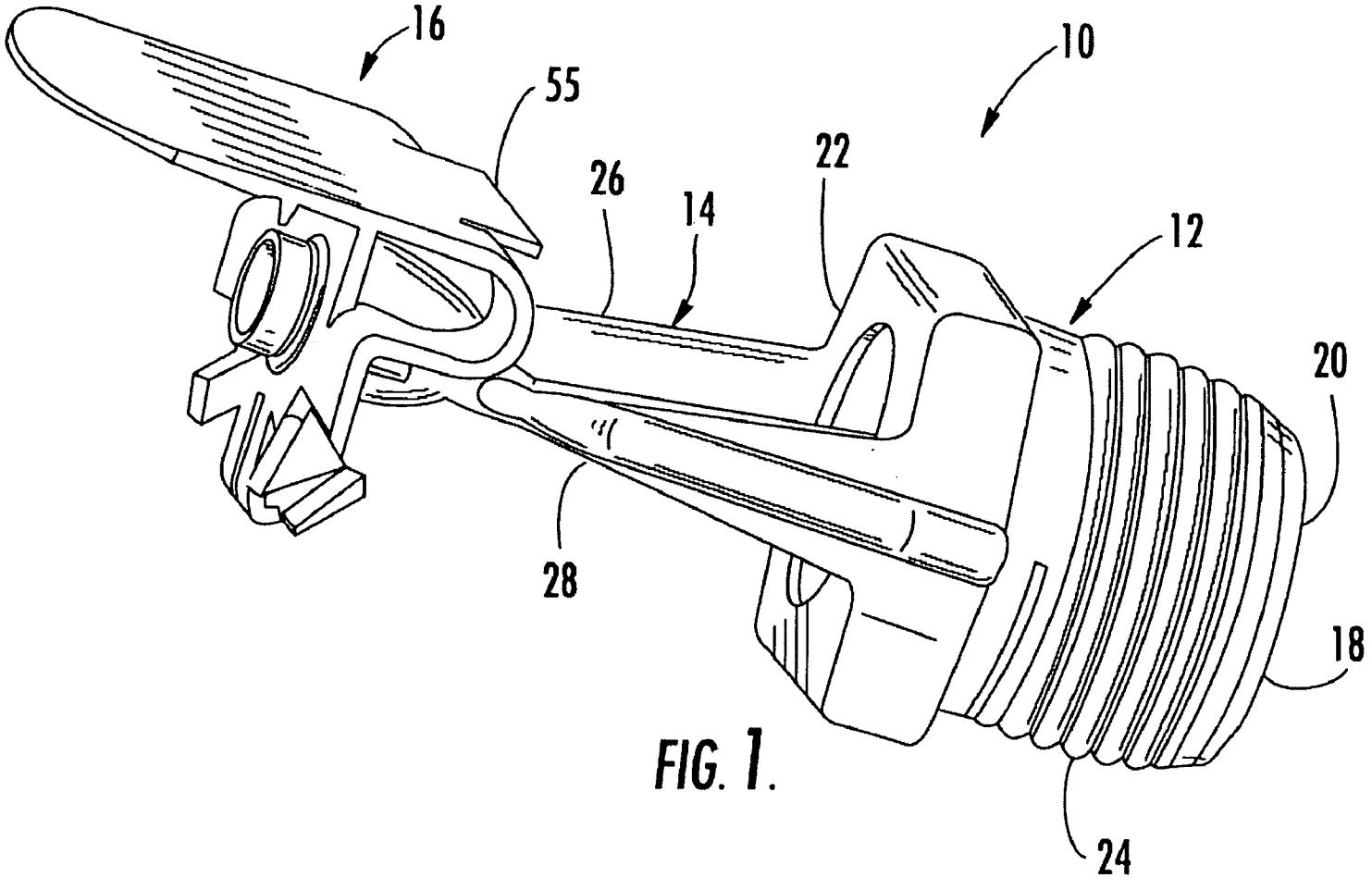
FIG. 1 is a side perspective view of one embodiment of the sprinkler head of the present invention.

Referring to FIG. 1, the numeral 10 generally designates a sprinkler head assembly of the present invention. As will be more fully described below, sprinkler head assembly 10 is adapted to adjust the flow of fire suppressant liquid, such as water, through the sprinkler head assembly so that more fire suppressant liquid will flow from one side of the sprinkler head assembly. For example in a sidewall sprinkler application, more fire suppressant liquid will flow from the top half of the sprinkler head assembly so that the sprinkler head assembly will produce a more uniform distribution of the fire suppressant liquid than heretofore known. Though illustrated as a sidewall sprinkler, sprinkler head 10 may be used in other applications where a uniform radial flow pattern is not desired, such as in pitched roof or wall applications or where equipment is located in proximity to the sprinkler, or the like.

Sprinkler head 10 includes a sprinkler head body or base 12, a frame 14, which extends from base 12, and a deflector 16, which is supported in spaced registry by frame 14 with respect to base 12. Base 12 includes a transverse passage 18 that extends through the base to provide an inlet opening 20 and an outlet opening 22 for discharging the fire suppressant liquid. Base 12 is typically a machined bronze casting that includes a threaded portion 24 for mounting the sprinkler head assembly to a supply fitting, as will be understood by those skilled in the art.

Figure 5:
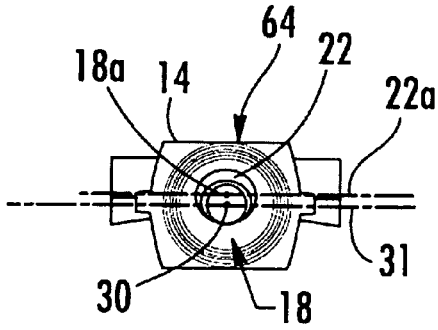
FIG. 5 is an end view of the inlet end of the sprinkler head of FIG. 1.

In the illustrated embodiment, frame 14 is integral with base 12 and includes a pair of spaced arms 26 and 28, which extend from opposite sides of base 12 and which are substantially aligned along a center axis 30 (FIG. 2) of sprinkler head 10. It should be understood that frame 14 may be separately formed and then mounted to the base. As best seen in FIG. 3, arms 26 and 28 are preferably equally spaced from center axis 30 and, further, lie in a common plane 31 (FIG. 5). In the illustrated embodiment, when sprinkler head 10 is mounted in a sidewall application, plane 31 comprises a generally horizontal plane; however, it should be understood that in other applications, plane 31 may assume other orientations.

As noted above, frame 14 supports deflector 16 in spaced registry from outlet opening 22 and, further, provides a mount for a trigger mechanism, such as heat sensitive trigger (shown in phantom in FIG. 3), such as a glass bulb or the like. The trigger mechanism holds a seal over outlet opening 22 to thereby seal outlet opening 22 until a temperature associated with a fire is detected in which case the trigger mechanism will release the pressure on the seal on outlet opening 22 so that the pressure from the fire suppressant liquid will lift the seal off the outlet opening and flow from outlet opening 22. Further details of the seal and trigger mechanism are not provided herein as they are commonly known in the art. However, reference is made to Viking Corporation U.S. Pat. No. 5,826,665, which is herein incorporated by reference in its entirety, for a suitable example of a trigger mechanism and seal.

In the illustrated embodiment, sprinkler head assembly 10 comprises a sidewall sprinkler assembly, which is adapted to direct the flow of fire suppressant liquid from outlet opening 22 in canopy that reaches across the area to be protected in forward, lateral, and downward directions from the sprinkler. In addition, the canopy wets the wall in which the sprinkler head assembly is mounted. As is understood, the canopy is created by the dispersion of the fire suppressant liquid by deflector 16.

Figure 2:
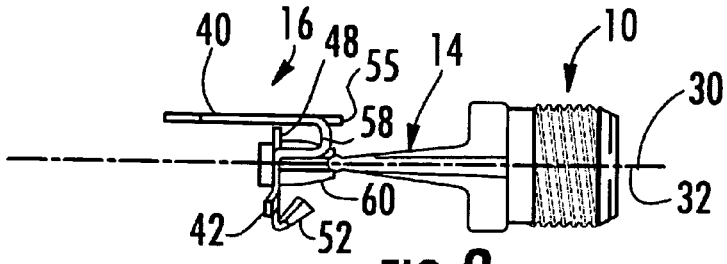
FIG. 2 is a side elevation view of the sprinkler head of FIG. 1.
Figure 3:
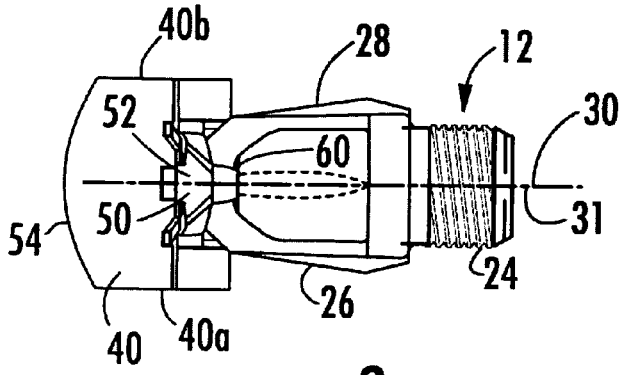
FIG. 3 is a bottom plan view of the sprinkler head of FIG. 1.
Figure 4:
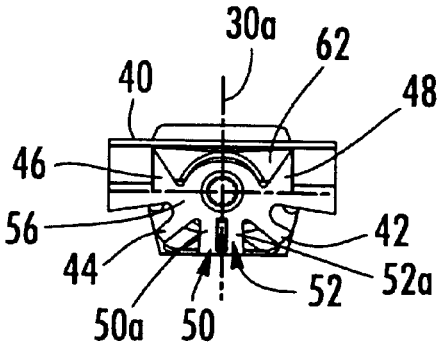
FIG. 4 is an end view of the outlet end of the sprinkler head of FIG. 1.

Referring to FIGS. 2–4 and 6–9, deflector 16 includes a central body or portion 56, which includes a central mounting opening 56*a* to mount deflector 16 to frame 14, and a generally horizontal portion 40, which is supported and spaced from and above central axis 30 and, further, above central body 56 to form an opening 62. A plurality of tines 42, 44, 46, 48, 50, and 52, extend from central body 56, which together with horizontal portion 40 disperse the fire suppressant liquid flowing from outlet opening 22 so that the fire suppressant liquid will be dispersed outwardly in the direction of the sprinkler head central axis 30 away from the sprinkler head assembly, downwardly with respect to sprinkler head central axis 30, and laterally from the sprinkler assembly to achieve a greater distribution of water across the floor and, further, to achieve better wall wetting at lower flows, as will be more fully described below. Central portion 56 therefore provides a hub from which tines 42, 44, 46, 48, 50, 52, and horizontal portion 44 generally extend. Tines 42 and 44 are spaced generally symmetrically from central vertical axis 30*a* (FIG. 4).

Figure 8:
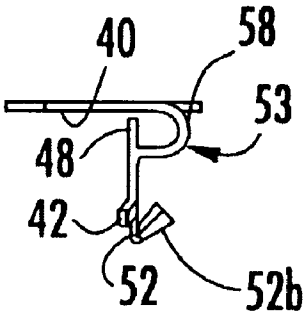
FIG. 8 is a side elevation view of the deflector of FIG. 6.

Referring to FIG. 8, tines 46 and 48 are generally coplanar with central portion 56 and extend upwardly toward horizontal portion 40 but are spaced from the lower surface of horizontal portion 40. In addition, tines 46 and 48 are generally triangular in shape. As best seen in FIG. 8, tines 42 and 44 are angled outwardly in a direction away from base 12 generally along central axis 30 in the direction of flow the fire suppressant liquid from outlet opening 22. Therefore, tines 42 and 44 are angled from the plane defined by central portion 56.

Figure 9:
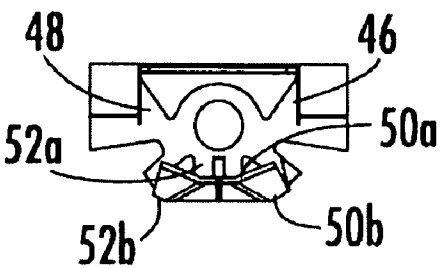
FIG. 9 is a rear end view of the deflector of FIG. 6.
Figure 7:
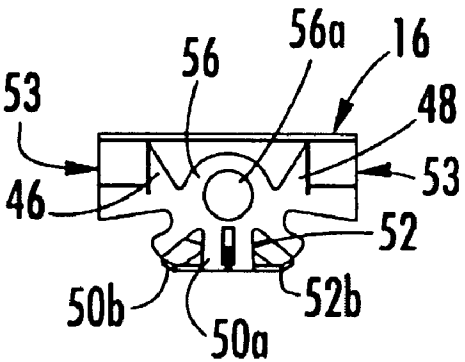
FIG. 7 is a front end view of the deflector of FIG. 6.
Figure 10:
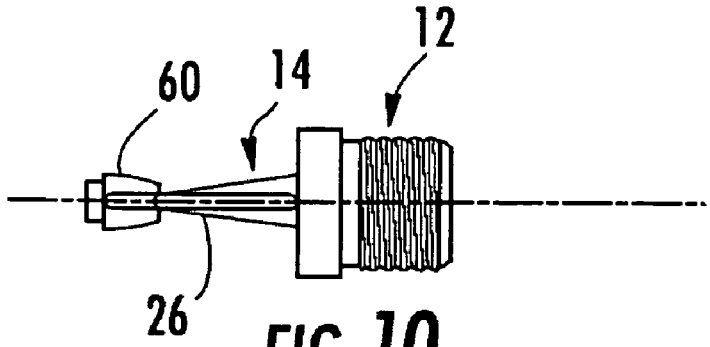
FIG. 10 is a side view of the deflector body of FIG. 1.

Referring to FIGS. 8 and 9, tines 50 and 52 include downwardly depending portions 50*a* and 52*a*, which extend from and are generally coplanar with central portion 56 (and coplanar with tines 46 and 48) and, further, include enlarged tabs 50*b* and 52*b* that are angled upwardly with respect to downwardly depending portions 50*a* and 52*a* in a direction toward central axis 30 and toward outlet opening 22. Tabs 50*b* and 52*b* help lift the fire suppressant liquid flowing from outlet opening and, moreover, create a wall of fire suppressant that wets the wall on which sprinkler head assembly is mounted and the adjacent side wall.

Figure 6:
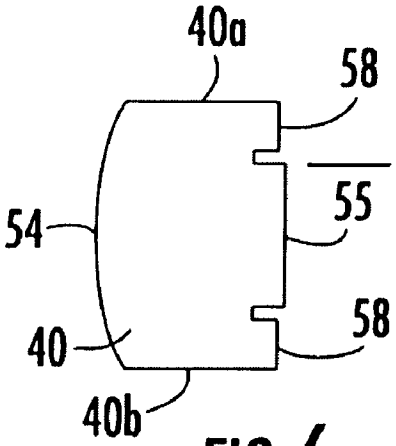
FIG. 6 is a top plan view of the deflector of the sprinkler head of FIG. 1.

As best understood from FIG. 2, deflector 16 is formed from a blank or plate, typically a brass plate. As best seen in FIG. 6, generally horizontal portion 40 comprises a generally rectangular-shaped portion 53 with opposed edges 40*a* and 40*b* and a generally curved outer edge 54. Outer edge 54 is preferably symmetrically curved relative to central axis 30. Horizontal portion 40 is connected to central portion 56 by a pair of reverse curved arms 58 which straddle opening 62 and a central rearwardly extending tab 55. Opening 62 is generally located above central axis 30, though it may include portions that extend to or below central axis 30.

Figure 11:
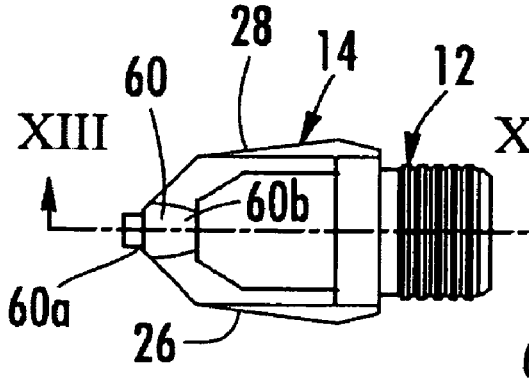
FIG. 11 is a top plan view of the sprinkler head body of FIG. 10.
Figure 12:
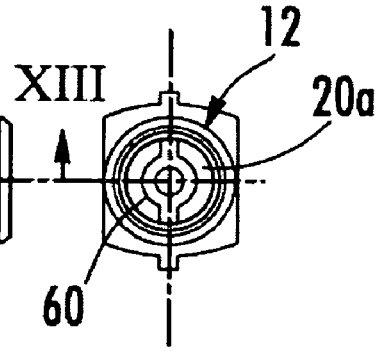
FIG. 12 is a right end view of the sprinkler body of FIG. 11.
Figure 13:
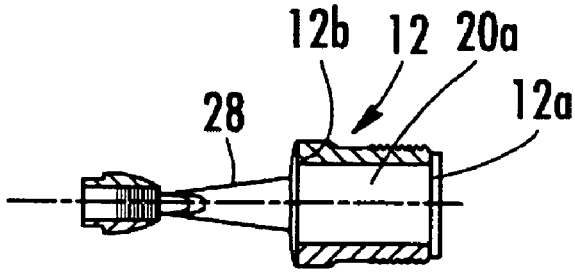
FIG. 13 is a cross-section view taken through line XIII—XIII of FIG. 11.
Figures 14, 15, 16:
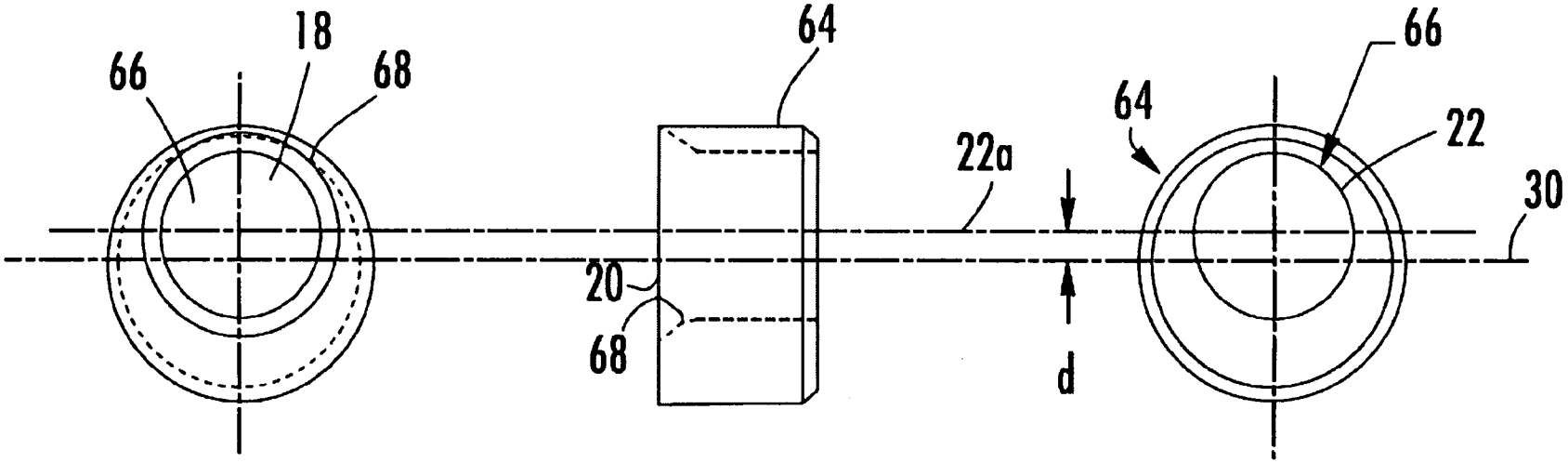
FIG. 14 is an enlarged side view of the bushing of the sprinkler head of FIG. 1.
FIG. 15 is a left or input end view of the bushing of FIG. 14.
FIG. 16 is a right or output end view of the bushing of FIG. 14.

As noted above, central portion 56 of sprinkler deflector 16 mounts deflector 16 to frame 14 in spaced registry with outlet 22. As best seen in FIG. 11, arms 26 and 28 of frame 14 are interconnected by a boss 60. Boss 60 includes an annular shoulder 60*a*, which provides a mounting surface for deflector 16 and, further, includes a diverging surface 60*b*, which diverges from central axis 30 in a direction-away from the outlet opening 22 to thereby disperse the fire suppressant liquid flowing from outlet opening 22. In the illustrated embodiment, diverging surface 60*b* has a conical shape or parabolic shape; however it can be appreciated that other surfaces may be used to deflect the fire suppressant liquid emerging from outlet opening 22. In this manner, the fire suppressant liquid flowing from outlet opening 22 is directed through opening 62 between horizontal portion 40 and central portion 56. Boss 60 also provides a mounting surface for the heat sensitive trigger, which typically extends between boss 60 and the seal and an optional spring, such as a Belleville spring, which together with the seal seals outlet opening 22.

In the illustrated embodiment, transverse passage 18 includes a transverse axis 18*a*, which is offset from the central axis 30 and is therefore offset from plane 31. In this manner, when fire suppressant liquid flows from outlet opening 22 more fire suppressant liquid will flow to one side of or above axis 30 and plane 31 and, therefore, more water will be directed through opening 62 of sprinkler deflector 16. With the redistribution of the flow of fire suppressant liquid through sprinkler head 10, it has been found that an improved distribution of the fire extinguishing liquid is achieved with greater wall wetting and, further, a greater distribution of the water across the floor of the area to be protected. For example, axis 18*a* is preferably offset from axis 30 to increase the proportion of the fire suppressant liquid above axis 30 in a range of 65% to 85%, more preferably 70% to 80% and, most preferably about 75%. For example, axis 18*a* may be offset from axis 30 a distance in a range of 1/64 of an inch to 3/16 of an inch to 1/8 of an inch.

Referring to FIGS. 5, and 10–16, this offset may be achieved by inserting a bushing 64 into base 12 of sprinkler head 10. For example, referring to FIGS. 5, 12, and 13, base 12 may be formed, such as by machining with an enlarged passageway 20*a* (FIG. 13) that extends from inlet side 12*a* to outlet side 12*b* of base 12. Bushing 64 is then inserted into passageway 20*a*, with bushing 64 including a transverse opening 66 that is offset from the outer perimeter of the bushing. Preferably, the inlet side comprises a tapered opening 68, which defines inlet opening 20 of base 12. Bushing 64 may extend through passageway 20*a* or may terminate at an intermediate point between inlet opening 20 and outlet opening 22. Alternately, this offset orifice may be formed, such as by machining it, into the base.

The redistribution of flow of water through the sprinkler head may also be achieved by offsetting the deflector or the boss, for example by providing a frame which supports the deflector or deflector or boss offset from plane 31 or a combination of an offset orifice, an offset boss, and/or an offset deflector.

Figure 17:
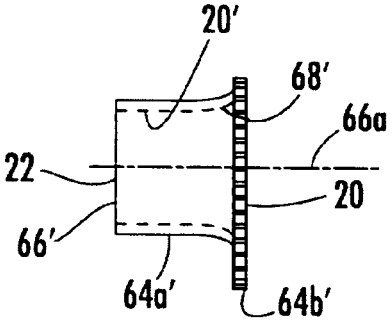
FIG. 17 is a side elevation view of another embodiment of the bushing of the sprinkler head of the present invention.
Figure 18:
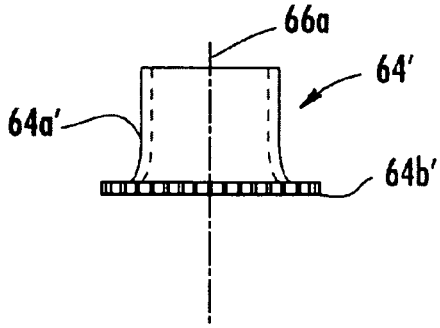
FIG. 18 is a top plan view of the bushing of FIG. 17.
Figure 19:
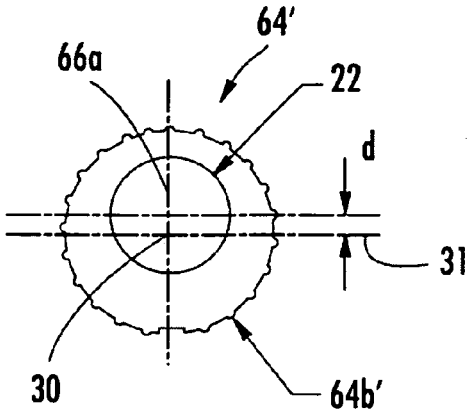
FIG. 19 is a right end view of the bushing of FIG. 17.

Referring to FIGS. 17–19, the numeral 64' designates another embodiment of a bushing that is suitable to provide or form the offset orifice in sprinkler head 10. Bushing 64' includes a cylindrical body 64*a*', with a flange 64*b*', and a transverse passage, which defines transverse passage 66' similar to passage 66 and, further, which includes a tapered opening 68' on one end, to provide inlet opening 20 and a second opening on its other end to form outlet opening 22. Similar to the previous embodiment, outlet opening 22, which is formed by opening 66, is offset from central axis 30 and plane 31 so that more fire extinguishing liquid flows above plane 31 than below plane 31. Preferably, the central axis 66*a* of passage 66 is offset to achieve a proportion in a range of 65% to 85%, more preferably 70% to 80% and, most preferably about 75% of the fire suppressant liquid flowing above plane 31. For example, axis 66*a* may be offset from central axis 30 in a range of 1/64 to 3/16 of an inch and, more preferably, in a range of 1/32 to 1/8 of an inch.

Figure 20:
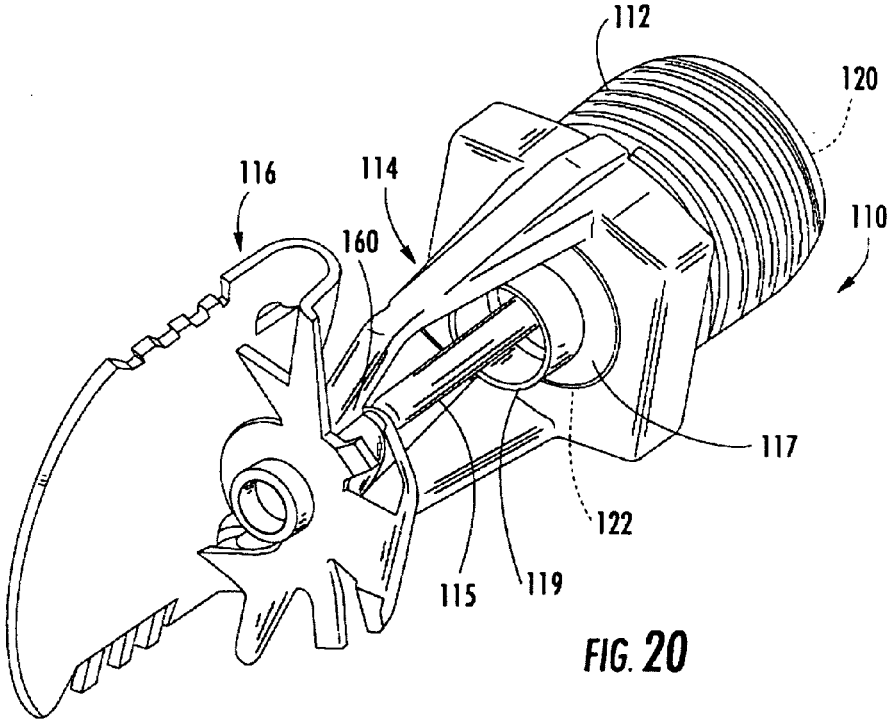
FIG. 20 is a perspective view of another embodiment of the sprinkler head of the present invention.
Figure 21:
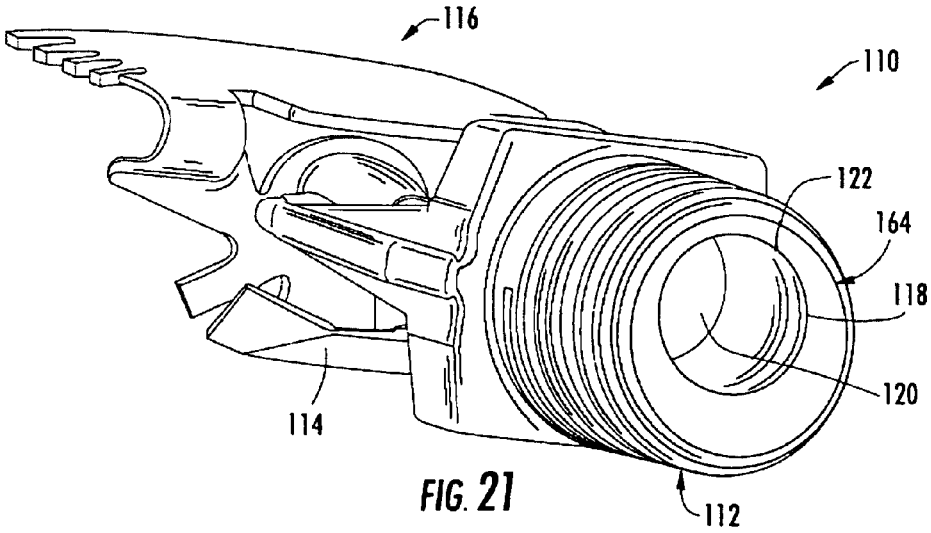
FIG. 21 is an inlet end perspective view of the sprinkler head of FIG. 20.

Referring to FIGS. 20 and 21, the numeral 110 generally designates another embodiment of the sprinkler head assembly of the present invention. Similar to sprinkler head assembly 10, sprinkler head assembly 110 includes a sprinkler head body or base 112, a frame 114, which extends from body 112 and which supports a deflector 116 in spaced registry with the outlet opening 122 of sprinkler head body 112. Similar to the previous embodiment, sprinkler head assembly 110 is adapted to direct the flow of fire suppressant liquid from outlet opening 122 in canopy that reaches across the area to be protected in forward, lateral, and downward directions from the sprinkler. Furthermore, sprinkler head assembly 110 is adapted to adjust the flow of fire suppressant liquid, such as water, through the sprinkler head assembly so that more fire suppressant liquid will flow from one side of the sprinkler head assembly than the other side of the sprinkler head so that a greater amount of the fire suppressant liquid can be directed to wet an area that demands a greater volume of water than the area wetted by the other side of the sprinkler.

As best seen in FIG. 20, a thermally sensitive trigger 115 extends between boss 160 of frame 114 and outlet opening 122. Positioned between trigger mechanism 115 and outlet opening 122 are a seal 117 and a cup-shaped member 119, which provides lateral support for the thermally sensitive trigger mechanism 115 and further holds the seal in place over outlet opening 122. In the illustrated embodiment, thermally sensitive trigger mechanism 115 comprises a frangible bulb; however, it can be appreciated that other trigger mechanisms may be used. For further details of suitable trigger mechanisms and mounting arrangements, reference is made to U.S. Pat. No. 5,826,665, which is herein incorporated by reference in its entirety.

Referring to FIG. 21, similar to the previous embodiment, sprinkler head 110 includes inlet opening 120 and outlet opening 122, which are offset relative to the central axis 130 of the sprinkler head assembly to thereby direct a greater proportion of the fire extinguishing liquid to one side or above the central axis and the central plane (131) so as to generate a canopy that achieves improved wall wetting and, further, improved distribution of the dispersed fire suppressant liquid across the area to be protected. This offset may be machined into base 112 or may be provided by a bushing 164, which is inserted into base 112, similar to the previous embodiment.

Referring to FIGS. 22–25, deflector 116 is of similar construction to deflector 16 and includes a central body or portion 156 with a plurality of projecting tines 142, 144, 146, 148, and 150 and a generally horizontal portion 140, which is supported from the central portion and spaced above the central axis 130 of the sprinkler head. Horizontal portion 140 is supported from central portion 156 by a pair of upwardly extending reverse curved arms 154, which space horizontal portion 140 above central portion 156 to thereby define an opening 162 through deflector 116. Similar to tines 46 and 48, tines 146 and 148 extend upwardly from central portion 156 and project into opening 162 and, further, comprise triangular members whose distal ends are spaced below horizontal portion 140.

Figure 24:
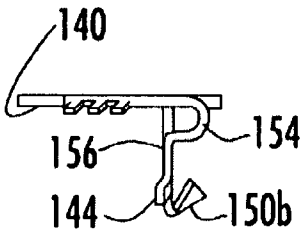
FIG. 24 is a side elevation view of the deflector of FIG. 22.
Figure 23:
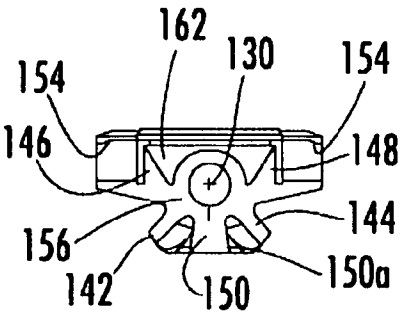
FIG. 23 is a front end view of the deflector of FIG. 22.
Figure 26:
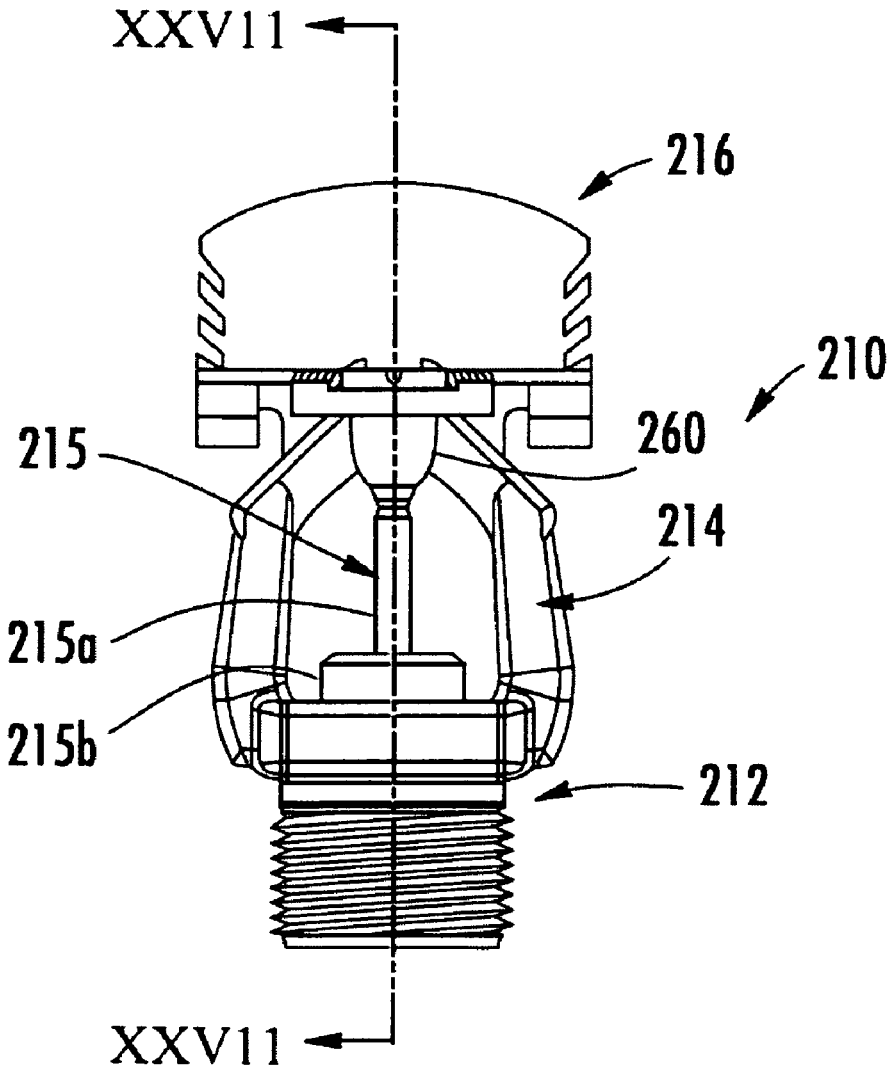
FIG. 26 is a bottom plan view of another embodiment of the sprinkler head assembly of the present invention.

As best seen in FIG. 24, tines 142 and 144 are angled outwardly and forwardly from central portion 156 in a direction generally along the central axis 130 away from outlet opening 122. Tine 150 includes a downwardly depending portion 150*a* and an angled portion 150*b*, which is upturned in a direction toward the central axis 130 and toward outlet opening 122 of sprinkler head assembly 110. Upwardly turned portion 150*b* has a transverse extent, which extends outwardly from either side of central vertical axis 130*a* of sprinkler 10 and forms a central portion 150*c* and lateral portions 150*d* and 150*e*. Lateral portions 150*d* and 150*e* extend laterally outward from central portion 150*c* and downwardly depending portion 150*a* and, further, are preferably angled relative to central portion 150*c* in a forward direction towards central portion 156 and toward central axis 130.

Figure 22:
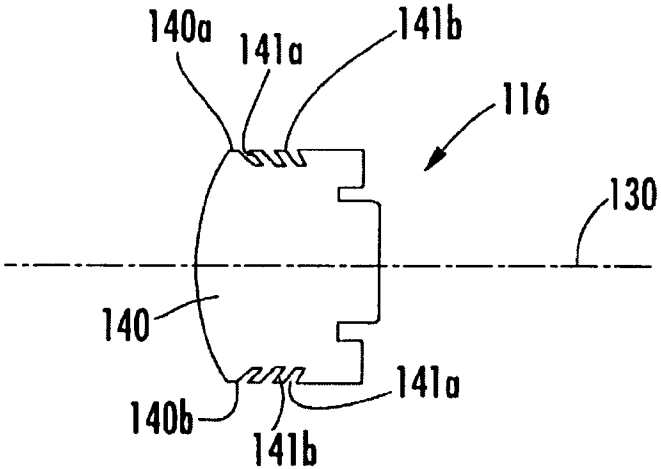
FIG. 22 is a top plan view of the deflector of the sprinkler head of FIG. 20.
Figure 25:
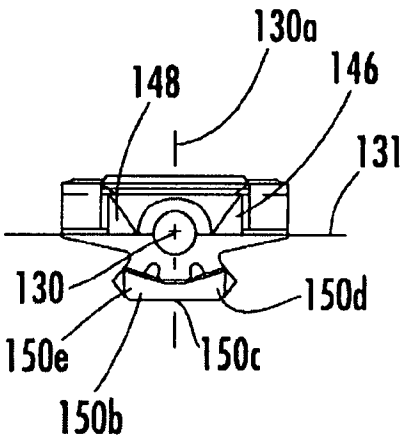
FIG. 25 is a rear end view of the deflector of FIG. 22.

As best seen in FIG. 22, generally upper horizontal portion 140 further includes a plurality of slots 141*a*, which extend into the opposed sides 140*a* and 140*b* of generally horizontal portion 140. Slots 141*a* form a plurality of spaced apart tines 141*b*, which assist in the further dispersion of the fire suppressant liquid emerging from the outlet opening of the sprinkler head body. In preferred form, slots 141*a* are angled in directions that diverge from central axis 130 away from outlet opening 122. Optionally, as best seen in FIG. 24, tines 141*b* may be angled downwardly from generally horizontal portion 140 towards central axis 130.

Referring to FIGS. 26–35, the numeral 210 designates another embodiment of the sprinkler head assembly of the present invention. Sprinkler head assembly 210 includes a base 212, a frame 214, and a deflector 216 similar to the previous embodiments. Also similar to the previous embodiments, sprinkler head assembly 210 is adapted to redirect the flow of fire extinguishing fluid through base 212 in a manner to direct more of the flow to one side of the sprinkler head assembly, such as above the central axis of the sprinkler head assembly, than from the other side of the sprinkler head assembly so that a greater amount of the fire suppressant liquid can be directed to wet an area that demands a greater volume of fire suppressant than the area wetted by the other side of the sprinkler head assembly.

Figure 27:
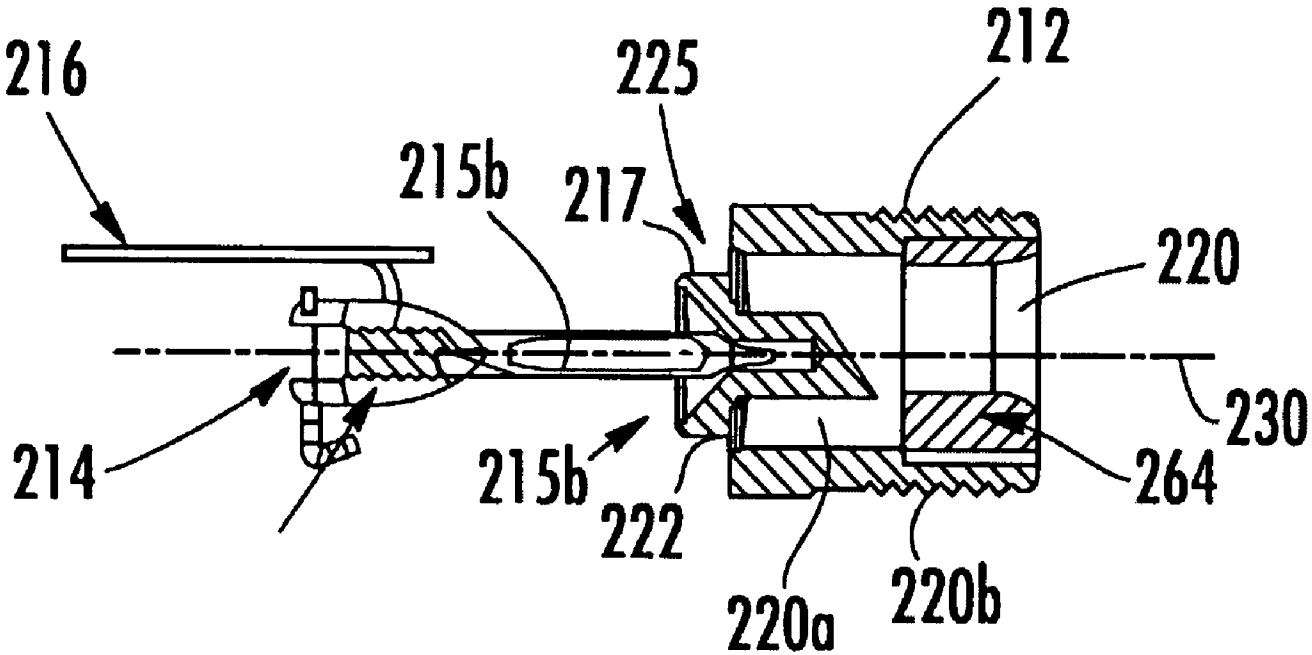
FIG. 27 is a cross-section view taken along line XXVII—XXVII of FIG. 26.
Figure 31:
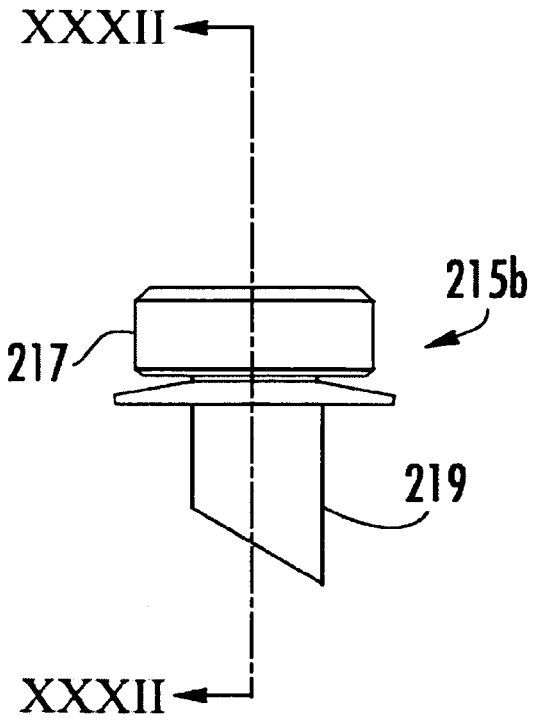
FIG. 31 is an enlarged side view of the thermally sensitive trigger holder or cup and spring assembly.
Figure 32:
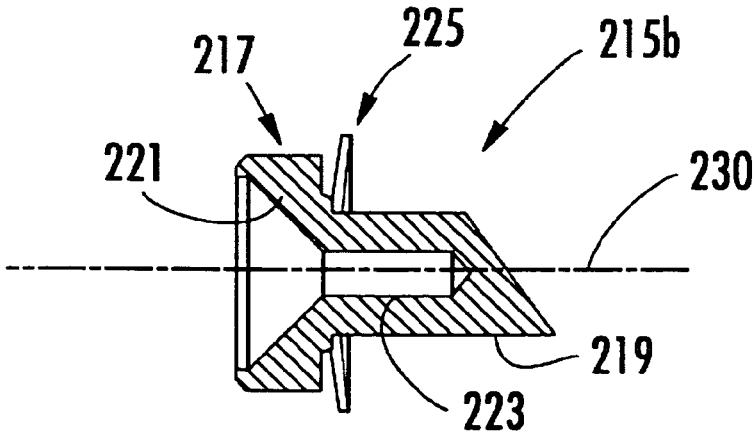
FIG. 32 is a cross-section taken along line XXXII—XXXII of FIG. 31.
Figure 33:
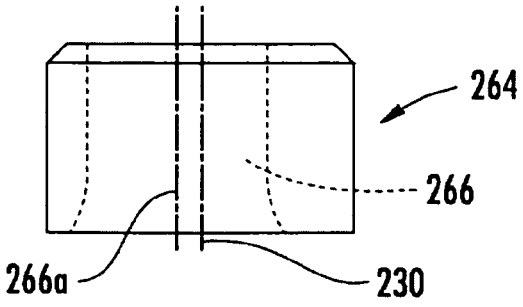
FIG. 33 is an enlarged side view of the bushing of the sprinkler head assembly.
Figure 34:
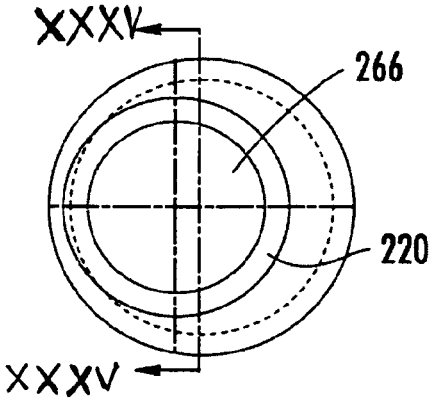
FIG. 34 is an end view of the bushing of FIG. 33.
Figure 35:
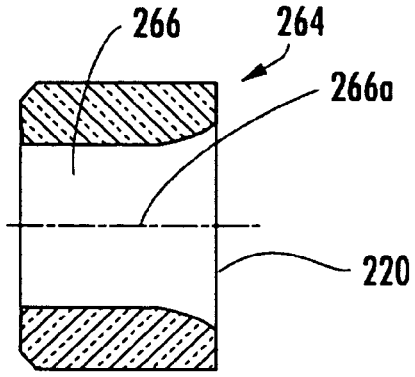
FIG. 35 is a cross-section taken along line XXXV—XXXV of FIG. 34.

Sprinkler head assembly 210 is opened upon the actuation of a thermally sensitive trigger assembly 215, which is mounted between boss 260 of frame 214 and base 212. In the illustrated embodiment, trigger assembly 215 extends into outlet opening 222 of base 212. Thermally sensitive trigger assembly 215 includes a thermally sensitive trigger member 215*a* and a thermally sensitive trigger member holder or cup 215*b*, which extends into outlet opening 222. As best seen in FIGS. 27, 31, and 32, holder 215*b* includes an annular collar 217 and a cylindrical member 219, which extends into outlet opening 222 of base 212. Annular collar 217 includes a conical-shaped recess 221 which is in communication with a cylindrical recess 223 of cylindrical member 219 and into which the end of thermally sensitive trigger member 215*a* is extended. In this manner, holder 215*b* provides lateral support for thermally sensitive trigger member 215*b*. In addition, mounted around cylindrical member 219 is an annular spring 225, such as a Belville spring, which is compressed when trigger member 215*a* is mounted between boss 260 and inserted into holder 215*b*. In this manner, when the thermally sensitive trigger member 215*a* releases the force on holder 217, for example when it detects a temperature associated with a fire, spring 225 will urge holder 217 outwardly from outlet opening 222 and together with the flow of pressure of the fire extinguishing liquid, will dislodge holder 215*b* from base 212, as would be understood by those skilled in the art.

As previously noted, sprinkler head body 210 is adapted to direct the flow of fire extinguishing fluid so a greater percentage of fire extinguishing fluid flows through one half of the sprinkler head. In the illustrated embodiment, sprinkler head 210 comprises a sidewall sprinkler and, further, is adapted to direct more of the flow of the fire extinguishing fluid above the central axis 230 of sprinkler head assembly 210. As best seen in FIG. 27, base 212 includes a transverse passage 220*a* that defines outlet opening 222 and, further, is formed to provide an enlarged section 220*b* of passageway 220*a* for receiving bushing 264 therein. Bushing 264, similar to the previous embodiments, provides an offset orifice and includes a passageway with a central axis 266*a* that is offset from central axis 230 of sprinkler head assembly 210. In the illustrated embodiment, axis 266 is offset above central axis 230 to offset inlet outlet opening 220 upwardly with respect to outlet opening 222. In this manner, bushing 264 directs a greater amount of the fire extinguishing fluid above central axis 230 so that a greater amount of fire extinguishing liquid will emerge from outlet 222 above central axis 230. Bushing 264 may be machined with threads to engage corresponding threads provided on base 212 and passageway 220*b* or may be friction fit into the passageway 220*b*.

Figure 29:
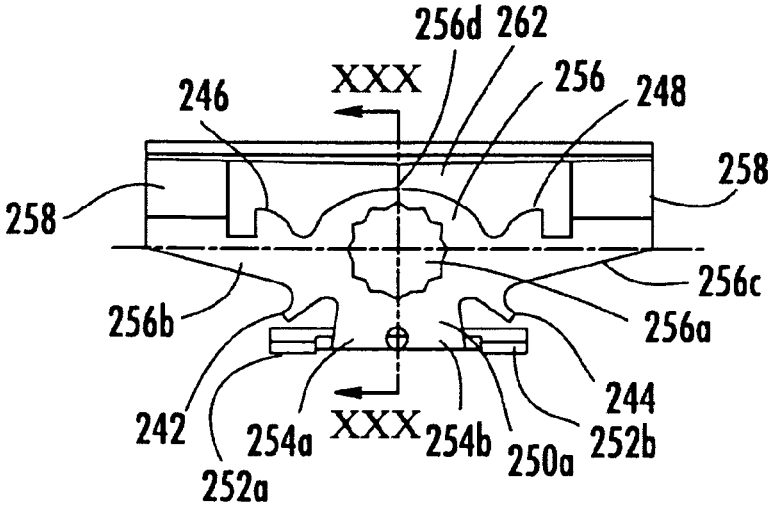
FIG. 29 is a front elevation view of the deflector of FIG. 28.

To further facilitate in the redistribution of the flow of the fire extinguishing fluid from sprinkler head assembly 210, deflector 16 is also adapted to "lift" the fire extinguishing fluid. As best seen in FIG. 29, deflector 16 includes a central body or portion 256 that includes a mounting opening 256*a* for securing deflector 16 to boss 260 of frame 214. Extending outwardly from central portion 256 are a plurality of tines or tabs 242, 244, and 250. In addition, deflector 216 includes an upper generally planar portion 240 that is spaced above central axis 230 of sprinkler head assembly 210 and, further, spaced above central portion 256 to thereby form an opening 262 through deflector 216. Though illustrated as generally parallel with central axis 230, upper planar portion 215 may be angled with respect to central axis 230, for example in a range of approximately 1° to 10° and, more preferably, approximately 2°. Upper planar portion 240 is connected to central portion 256 by curved arms 258, which extend upwardly from lateral extensions 256*b* and 256*c* of central portion 256. Furthermore, extending upwardly from lateral extensions 256*b* and 256*c* are another pair of tines or tabs 246 and 248, which project up into opening 262. In the illustrated embodiment, tabs or tines 246 or 248 comprise quarter-round shaped members, which are spaced inwardly from reverse curve arms 258 and, further, terminate at a point spaced below upper planar portion 240 and also below the uppermost portion 256*d* of central portion 256.

Figure 28:
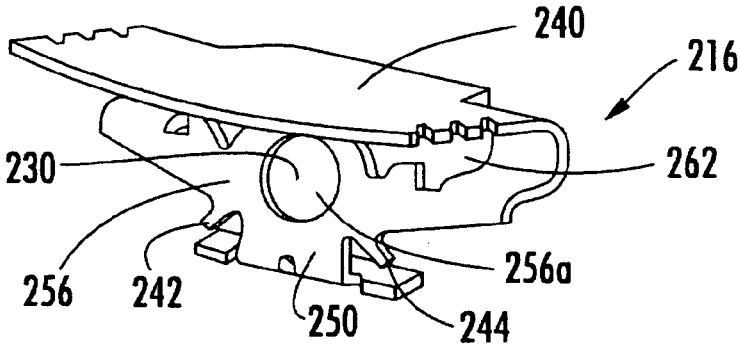
FIG. 28 is an enlarged perspective view of the deflector of sprinkler head assembly of FIG. 26.
Figure 30:
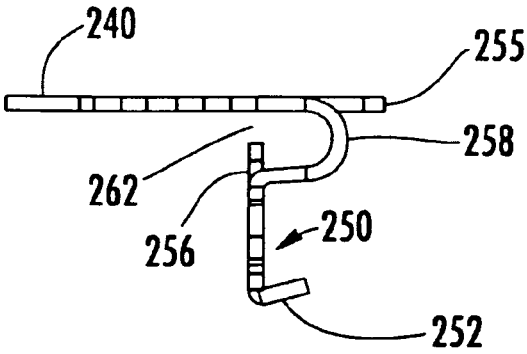
FIG. 30 is a side elevation view of the deflector of FIG. 29.

In the illustrated embodiment, tines or tabs 242, 244, 246, and 248 are generally coplanar with central portion 256, as well as a downwardly depending central portion 250*a* of tine 250. As best seen in FIGS. 28–30, tine 250 further includes a rearwardly extending portion 252 that is angled with respect to central portion 250*a* toward the outlet opening of sprinkler head 210. Rearwardly extending portion 252 includes a lateral extent greater than central portion 250*a* and, further, includes portions 252*a* and 252*b* that project outwardly from central portion 250*a*. In the illustrated embodiment, rearward extending portion 252 is generally planar and, further, angled slightly upwardly toward central axis 230. Optionally, rearwardly extending portion 252 may be formed from two members that are aligned and are in juxtaposition to form a substantially continuous member. In which case, the portions of portion 252 are formed by the lower discrete portions 254*a* and 254*b* of central member 250*a*.

Again referring to FIG. 30, upper planar portion 240 further includes a rearwardly extending tab 255 which projects rearwardly toward the outlet opening of sprinkler head 210 and beyond reverse curve arcuate arms 258. In addition, portion 240 includes a plurality of angled tines 241 at its opposed edges 240*a*. Tines 241 are angled away from central axis 230 and also away from outlet opening 222 of base 212.

It can be appreciated from the foregoing that the sprinkler head assemblies of the present invention, especially when used in a sidewall sprinkler application, produce a better distribution of the fire suppressant liquid across the area to be protected, including more uniform wall wetting than heretofore known.

While several forms of the invention have been shown and described, other forms will now be apparent to those skilled in the art. Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

I claim:

1. A sprinkler head assembly comprising:

a sprinkler head body having a transverse passage extending therethrough, said transverse passage providing an inlet opening and an outlet opening, and said sprinkler head body having a central axis extending through said transverse passage, said central axis lying in a reference plane;

a frame including a pair of arms extending from said body from opposed sides of said body, and said plane extending through said arms;

a deflector mounted to said frame spaced from said outlet opening for deflecting fire extinguishing liquid flowing from said outlet opening to disperse the fire extinguishing liquid over a desired area; and wherein a central axis of said transverse passage is offset relative to said reference plane to direct a greater proportion of the fire extinguishing liquid that flows from the outlet opening of the sprinkler head body to the one side of said plane than the other side of said plane.

2. The sprinkler head assembly according to claim 1, wherein said sprinkler head assembly is adapted to direct a proportion in range of 55% to 85% of the fire extinguishing liquid to said one side of said plane.

3. The sprinkler head assembly according to claim 2, wherein said sprinkler head assembly is adapted to direct a proportion in range of 60% to 80% of the fire extinguishing liquid to said one side of said plane.

4. The sprinkler head assembly according to claim 3, wherein said sprinkler head assembly is adapted to direct a proportion in range of 65% to 75% of the fire extinguishing liquid to said one side of said plane.

5. The sprinkler head assembly according to claim 1 wherein said central axis of said transverse passage is offset relative to said central axis of said sprinkler head body wherein a greater proportion of the fire extinguishing liquid flowing from said outlet opening flows above said plane than below said plane.

6. The sprinkler head assembly according to claim 1, wherein said transverse passage is adapted to direct a greater proportion of the fire extinguishing liquid above said plane than below said plane.

7. The sprinkler head assembly according to claim 1, wherein said frame includes a boss and said deflector is mounted to said boss, and said boss being adapted to direct a greater proportion of the fire extinguishing liquid above said plane than below said plane.

8. The sprinkler head assembly according to claim 7, wherein said boss includes a diverging surface, said diverging surface being offset from said plane said diverging surface directs a greater proportion of the fire extinguisher liquid above said plane than below said plane.

9. The sprinkler head assembly according to claim 1, wherein said deflector comprises a central body, a plurality of tines extending from said central body, and a generally horizontal portion supported from said central body above said central axis and spaced from said central body to thereby define an opening through said deflector below said generally horizontal portion, said central body being mounted to said frame and being generally perpendicular to said central axis, and at least one tine having a portion turned upwardly in a direction toward said central axis and toward said outlet opening.

10. The sprinkler head assembly according to claim 9, wherein at least two tines have portions turned upwardly in a direction toward said central axis and toward said outlet opening.

11. The sprinkler head assembly according to claim 9, wherein at least a pair of said tines are angled outwardly from said central body in a direction generally along said central axis away from said outlet opening.

12. The sprinkler head assembly according to claim 9, wherein said generally horizontal portion comprises a plate member with opposed sides extending generally parallel to said central axis and an outer edge generally perpendicular to said central axis.

13. The sprinkler head assembly according to claim 9, wherein at least a pair of said tines extends from said central body in a direction away from said central axis toward said generally horizontal portion.

14. The sprinkler head assembly according to claim 13, wherein said pair of said tines are coplanar with said central body.

15. The sprinkler head assembly according to claim 13, wherein said pair of said tines comprise triangular-shaped tines.

16. The sprinkler head assembly according to claim 1, said sprinkler head body including a bushing a bushing, said bushing defining said transverse passage.

17. A sprinkler head assembly comprising:

a sprinkler head body having a transverse passage extending therethrough, said transverse passage providing an inlet opening and an outlet opening, and said sprinkler head body having a central axis extending through said transverse passage, said central axis lying in a reference plane;

a frame including a pair of arms extending from said body from opposed sides of said body, and said plane extending through said arms;

a deflector mounted to said frame spaced from said outlet opening for deflecting fire extinguishing liquid flowing from said outlet opening to disperse the fire extinguishing liquid over a desired area; and said transverse vassal including a central axis offset relative to said central axis of said sprinkler head body wherein a greater proportion of the fire extinguishing liquid flowing from said outlet opening flows above said plane than below said plane, wherein said central axis of said transverse passage is offset from said central axis of said sprinkler head body in a range of 1/64 inch to 3/16 inch.

18. The sprinkler head assembly according to claim 17, wherein said central axis of said transverse passage is offset from said central axis of said sprinkler head body in a range of 1/32 inch to 1/8 inch.

19. The sprinkler head assembly according to claim 17, further comprising a bushing, said bushing defining said transverse passage and defining said outlet opening, said outlet opening having a central axis spaced from said central axis of said sprinkler head body wherein said outlet opening directs a greater proportion of the fire extinguishing liquid that flows from the sprinkler head body to said one side of said plane than the other side of said plane as the fluid flows from said outlet opening.

20. The sprinkler head assembly according to claim 17, wherein said deflector includes at least one tine having a portion turned upwardly in a direction toward said central axis of said sprinkler head body and toward said outlet opening.

21. A sprinkler head assembly comprising:

a sprinkler head body having a transverse passage extending therethrough, said transverse passage providing an inlet opening and an outlet opening, and said sprinkler head body having a central axis extending through said transverse passage, said central axis lying in a reference plane;

a frame including a pair of arms extending from said body from opposed sides of said body, and said plane extending through said arms;

a deflector mounted to said frame spaced from said outlet opening for deflecting fire extinguishing liquid flowing from said outlet opening to disperse the fire extinguishing liquid over a desired area; and said transverse passage including a central axis offset relative to said plane wherein a greater proportion of the fire extinguishing liquid flowing from said outlet opening flows above said plane than below said plane, wherein said central axis of said transverse passage is offset from said plane in a range of 1/64 inch to 3/16 inch.

22. The sprinkler head assembly according to claim 21, wherein said outlet opening is offset from said plane in a range of 1/32 inch to 1/8 inch.

23. The sprinkler bead assembly according to claim 9, further comprising a bushing, said bushing defining said transverse passage and defining said outlet opening, said outlet opening having a central axis spaced from said central axis of said sprinkler head body wherein said outlet opening directs a greater proportion of the fire extinguishing liquid that flows from the sprinkler head body to said one side of said plane than the other side of said plane as the fluid flows from said outlet opening.

24. The sprinkler head assembly according to claim 21, wherein said deflector includes at least one tine having a portion turned upwardly in a direction toward said central axis of said sprinkler head body and toward said outlet opening.

25. A sprinkler head assembly comprising:

a sprinkler head body having a transverse passage extending therethrough, said transverse passage providing an inlet opening and an outlet opening and said sprinkler head body having a central axis extending through said transverse passage; a frame including a pair of arms extending from said body from opposed sides of said body; and a deflector mounted to said frame spaced from said outlet opening for deflecting fire extinguishing liquid flowing from said outlet opening to disperse the fire extinguishing liquid over a desired area, said deflector comprising:

a central body; and a plurality of tines extending from said central body, and a generally horizontal portion supported from said central body above said central axis and spaced from said central body to thereby define an opening through said deflector below said generally horizontal portion, said central body being mounted to said frame and being generally perpendicular to said central axis, at least one tine having a portion turned upwardly in a direction toward said central axis and toward said outlet opening, said generally horizontal portion comprising a plate member with opposed sides encoding generally parallel to said central axis and an outer edge generally perpendicular to said central axis, and wherein each of said opposed sides of said generally horizontal portion includes at least one slot extending into said plate member.

26. The sprinkler head assembly according to claim 25, wherein each of said opposed sides of said generally horizontal portion includes a plurality of said slots.

27. The sprinkler head assembly according to claim 26, wherein said slots form tines, said tines of said horizontal portion being angled in a direction downwardly from said generally horizontal portion toward said central axis.

28. The sprinkler head assembly according to claim 26, wherein said slots form tines, said tines of said horizontal portion being angled in a direction away from said outlet opening.

29. The sprinkler head assembly according to claim 25, wherein said central axis lies in a reference plane, said transverse passage having a central axis at said outlet opening spaced from said central axis of said sprinkler head body wherein said outlet opening directs a greater proportion of the fire extinguishing liquid that flows from the sprinkler head body to said one side of said plane than the other side of said plane as the fluid flows from said outlet opening.

30. A sprinkler head assembly comprising:

a sprinkler head body having a transverse passage extending therethrough, said transverse passage providing an inlet opening and an outlet opening, and said sprinkler head body having a central axis extending through said transverse passage;

a frame including a pair of arms extending from said body from opposed sides of said body; and a deflector mounted to said frame spaced from said outlet opening for deflecting fire extinguishing liquid flowing from said outlet opening to disperse the fire extinguishing liquid over a desired area, said deflector comprising:

a central body:

a plurality of tines extending from said central body; and a generally horizontal portion supported from said central body above said central axis and spaced from said central body to thereby define an opening through said deflector below said generally horizontal portion, said central body being mounted to said frame and being generally perpendicular to said central axis, at least one tine having a portion turned upwardly in a direction toward said central axis and toward said outlet opening, and said generally horizontal portion comprising a plate member with opposed sides extending generally parallel to said central axis of said sprinkler head body and an outer edge generally perpendicular to said central axis of said sprinkler head body wherein said outer edge comprises a curved outer edge.

31. The sprinkler head assembly according to claim 30, wherein said curved outer edge comprises a symmetrically curved outer edge relative to the central axis of the sprinkler head body.

32. The sprinkler head assembly according to claim 30, wherein said central axis lies in a reference plane, said sprinkler head body being adapted to direct a greater portion of the fire extinguishing liquid that flows from said outlet opening to said one side of said plane than the other side of said plane.

33. The sprinkler head assembly according to claim 30, wherein at least one of said opposed sides of said generally horizontal portion of said deflector includes a slot extending into said plane member.

34. The sprinkler head assembly according to claim 30, wherein said at least one tine comprises a central tine.

35. A sprinkler head assembly comprising:

a sprinkler head body having a transverse passage extending therethrough, said transverse passage providing an inlet opening and an outlet opening, and said sprinkler head body having a central axis extending through said transverse passage, said central axis lying in a reference plane;

a frame including a pair of arms extending from said body from opposed sides of said body, and said plane extending through said arms;

a deflector mounted to said frame spaced from said outlet opening for deflecting fire extinguishing liquid flowing from said outlet opening to disperse the fire extinguishing liquid over a desired area; and said deflector comprising a central body, a plurality of tines extending from said central body, and a generally horizontal portion supported from said central body above said central axis and spaced from said central body to thereby define an opening through said deflector below said generally horizontal portion, said central body being mounted to said frame and being generally perpendicular to said central axis, and at least one tine having a portion turned upwardly in a direction toward said central axis and toward said outlet opening.

36. The sprinkler head assembly according to claim 35, wherein said at least one tine comprises a central tine.

37. The sprinkler head assembly according to claim 35, wherein at least two said tines have portions turned upwardly in a direction toward said central axis and toward said outlet opening.

38. The sprinkler head assembly according to claim 35, wherein at least a pair of said tines are angled outwardly from said central body in a direction generally along said central axis away from said outlet opening.

39. The sprinkler head assembly according to claim 35, wherein at least a pair of said tines extends from said central body in a direction away from said central axis toward said generally horizontal portion.

40. The sprinkler head assembly according to claim 39, wherein said pair of said tines are coplanar with said central body.

41. The sprinkler head assembly according to claim 40, wherein said pair of said tines comprise triangular-shaped tines.

42. The sprinkler head assembly according to claim 35, wherein said generally horizontal portion comprises a plate member with opposed sides extending generally parallel to said central axis and an outer edge generally perpendicular to said central axis.

43. The sprinkler head assembly according to claim 42, wherein each of said opposed sides of said generally horizontal portion includes at least one slot extending into said plate member.

44. The sprinkler head assembly according to claim 43, wherein each of said opposed sides of said generally horizontal portion includes a plurality of said slots.

45. The sprinkler head assembly according to claim 44, wherein said slots from tines, said tines of said horizontal portion being angled in a direction downwardly from said generally horizontal portion toward said central axis.

46. The sprinkler head assembly according to claim 44, wherein said slots form tines, said tines of said horizontal portion being angled in a direction away from said outlet opening.

47. The sprinkler head assembly according to claim 42, wherein said outer edge comprises a curved outer edge.

48. The sprinkler head assembly according to claim 47, wherein said outer edge comprises a symmetrically curved outer edge relative to the central axis of the sprinkler head body.

49. The sprinkler head assembly according to claim 35, wherein said sprinkler head assembly is adapted to direct a proportion in range of 55% to 85% of the fire extinguishing liquid to one side of said plane.

50. The sprinkler head assembly according to claim 49, wherein said sprinkler head assembly is adapted to direct a proportion in range of 60% to 80% of the fire extinguishing liquid to said one side of said plane.

51. The sprinkler head assembly according to claim 50, wherein said sprinkler head assembly is adapted to direct a proportion in range of 65% to 75% of the fire extinguishing liquid to said one side of said plane.

52. The sprinkler head assembly according to claim 35, wherein said sprinkler head body is adapted to direct a greater proportion of the fire extinguishing liquid above said plane than below said plane.

53. The sprinkler head assembly according to claim 52, wherein said transverse passage includes a central axis and said central axis of said transverse passage is offset relative to said central axis of said sprinkler head body wherein a greater proportion of the fire extinguishing liquid flowing from said outlet opening flows above said plane than below said plane.

54. The sprinkler head assembly according to claim 53, wherein said central axis of said transverse passage is offset from said central axis of said sprinkler head body in a range of 1/64 inch to 3/16 inch.

55. The sprinkler head assembly according to claim 48, wherein said central axis of said transverse passage is offset from said central axis of said sprinkler head body in a range of 1/32 inch to 1/8 inch.

56. The sprinkler head assembly according to claim 35, wherein at least one of said sprinkler head body and said frame is adapted to direct a greater proportion of the fire extinguishing liquid above said plane than below said plane.

57. The sprinkler head assembly according to claim 56, wherein said frame includes a boss and said deflector is mounted to said boss, and at least one of said sprinkler head body and said boss being adapted to direct a greater proportion of the fire extinguishing liquid above said plane than below said plane.

58. The sprinkler head assembly according to claim 35, wherein at least one of said sprinkler bead body and said deflector is adapted to direct a greater proportion of the fire extinguishing liquid above said plane than below said plane.

* * * * *

UNITED STATES PATENT AND TRADEMARK OFFICE

CERTIFICATE OF CORRECTION

PATENT NO. : 7,137,455 B2
APPLICATION NO. : 10/951080
DATED : September 27, 2004
INVENTOR(S) : Brian S. Green It is certified that error appears in the above-identified patent and that said Letters Patent is hereby corrected as shown below:

In col. 6, line 3, please delete “44” and insert --40-- therefor.
In col. 9, line 30, please delete “215b” and insert --215a-- therefor.
In col. 11, line 55, claim 8, please delete “extinguisher” and insert --extinguishing-- therefor.
In col. 12, line 25, claim 16, please delete the second instance of “a bushing.”
In col. 12, line 42, claim 17, please delete “vassal” and insert --passage-- therefor.
In col. 13, line 24, claim 23, please delete “bead” and insert --head-- therefor.
In col. 13, line 24, claim 23, please delete “9” and insert --21-- therefor.
In col. 13, line 43, claim 25, please insert a paragraph break before “a frame.”
In col. 13, line 63, claim 25, please delete “encoding” and insert --extending-- therefor.
In col. 16, line 40, claim 55, please delete “48” and insert --54-- therefor.
In col. 16, line 56, claim 58, please delete “bead” and insert --head-- therefor.

Signed and Sealed this

Twenty-seventh Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,137,455 B2
APPLICATION NO. : 10/951080
DATED : November 21, 2006
INVENTOR(S) : Brian S. Green It is certified that error appears in the above-identified patent and that said Letters Patent is hereby corrected as shown below:

In col. 6, line 3, please delete “44” and insert --40-- therefor.
In col. 9, line 30, please delete “215b” and insert --215a-- therefor.
In col. 11, line 55, claim 8, please delete “extinguisher” and insert --extinguishing-- therefor.
In col. 12, line 25, claim 16, please delete the second instance of “a bushing.”
In col. 12, line 42, claim 17, please delete “vassal” and insert --passage-- therefor.
In col. 13, line 24, claim 23, please delete “bead” and insert --head-- therefor.
In col. 13, line 24, claim 23, please delete “9” and insert --21-- therefor.
In col. 13, line 43, claim 25, please insert a paragraph break before “a frame.”
In col. 13, line 63, claim 25, please delete “encoding” and insert --extending-- therefor.
In col. 16, line 40, claim 55, please delete “48” and insert --54-- therefor.
In col. 16, line 56, claim 58, please delete “bead” and insert --head-- therefor.

This certificate supersedes Certificate of Correction issued March 27, 2007.

Signed and Sealed this

Seventeenth Day of April, 2007

JON W. DUDAS
*Director of the United States Patent and Trademark Office*